US006483522B1

(12) United States Patent
Chen et al.

(10) Patent No.: US 6,483,522 B1
(45) Date of Patent: Nov. 19, 2002

(54) METHOD AND CIRCUIT FOR DATA DRIVING OF A DISPLAY

(75) Inventors: Chien-Chih Chen, Hsin-Ying; Her-Shin Yang, Tainan Hsien, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/556,892

(22) Filed: Apr. 20, 2000

(51) Int. Cl.[7] ..... G09G 5/10; G09G 3/36
(52) U.S. Cl. ..... 345/690; 345/89
(58) Field of Search ..... 345/87–100, 215, 345/690, 692, 693

(56) References Cited

U.S. PATENT DOCUMENTS 5,510,807 A * 4/1996 Lee et al. ..... 345/103
5,648,793 A * 7/1997 Chen ..... 345/209
5,764,207 A * 6/1998 Maekawa et al. ..... 345/100
5,959,600 A * 9/1999 Uchino et al. ..... 345/100

* cited by examiner

*Primary Examiner*—Richard Hjerpe
*Assistant Examiner*—Alexander Eisen
(74) *Attorney, Agent, or Firm*—W. Wayne Liauh

(57) ABSTRACT

A method for data driving of a display, which is used to convert image signals into corresponding voltages so as to charge pixels of the display via data lines. It included the following steps: (1) a pre-selection step for dividing each binary image data composed of c bits into an MSB part P composed of a bits and an LSB part Q composed of b bits, wherein c=a+b, and selecting a base voltage for each pixel among a set of pre-determined voltages according to the MSB part P of the associated image data; (b) a pre-charging step for charging multiple data lines simultaneously to the base voltages of the pixels, respectively; (c) a post-selection step for selecting a corresponding voltage for each pixel according to the base voltage of the pixel and the LSB part Q of the associated image data; and (e) a post-charging step for charging multiple date lines in turn to the corresponding voltages of the pixels, respectively.

20 Claims, 8 Drawing Sheets

METHOD AND CIRCUIT FOR DATA DRIVING OF A DISPLAY

BACKGROUND OF THE INVENTION

1. Field of Invention

The present invention relates to a method and circuit for data driving of a display, especially to a method and circuit for data driving of a high resolution and high quality display, such as the poly-silicon TFT or single-crystal silicon TFT display.

2. Related Art

The basic display principle of the liquid crystal display (LCD) is that when a voltage is applied to the rod-shaped crystal molecule in the LCD, the direction of the rod-shaped crystal molecule will be changed, and light will also passes more or less. Therefore, if we can fully fill the space between two parallel glass plates with the liquid crystal and install many vertical and horizontal thin wires on each glass plate, then we can easily control the status of each pixel of the LCD by charging or discharging the corresponding wires, hence control the light. Because the LCD has the advantages of low power consumption, no radiation, fully flat display, and small space occupation, it has gradually replaced the conventional cathode ray tube (CRT) and become increasingly popular.

The thin-film transistor (TFT) is a kind of LCD technologies. For a TFT LCD, each of the pixels of the display is composed of a transistor and capacitors to control the pixel color; furthermore, the pixel information should be kept during the time between two consequent frame refresh of the display. In comparison with the conventional DSTN display, which may not be clearly seen under hard light and/or has only very limited viewing angle, the TFT LCD has greatly improved on these issues and comes into being the mainstream among the LCD technologies.

The data driving circuit used in a conventional TFT LCD usually charges pixels on one of the horizontal gate lines by using the vertical data lines in the manner of 1-to-1 during the scanning time an H-sync signal. During the period, the TFTs on that gate line should be turned on, and all the other TFTs on all other gate lines should be turned off. Since the numbers of pixels on a horizontal gate line are the same as the number of vertical data lines, therefore each vertical data line needs a digital-to-analog converter (DAC) and an operational amplifier as output buffer (OP buffer). For example, for a color display with the resolution of 1024*768, it needs 1024*3 (R, G, B)=3072 DACs and OP buffers. In general, the DAC used in the data driving circuit of a LCD usually utilizes the method of resistor string in conjunction with decoders to determine the voltage. For example, for a 6-bits grayscale driving circuit, it needs $2^6$=64 different voltages. Due to the large chip die area and the complexity in circuit, the above method is rarely used for data driving if the grayscale depth of an image pixel exceeds 8 bits.

FIG. 1 shows a time-to-voltage diagram of a conventional data driving method in the 1-to-1 manner.

For the LCD technologies with better electron mobility, such as poly-silicon TFT and single crystal silicon TFT, the charging time of each pixel is rather short and it is possible to use the 1-to-N data driving method and charge in the manner of time division. During the scanning time H of each H-sync signal, an OP buffer can be used to charge N pixels, that is, the charging time allocated for each pixel is only H/N. For example, for a color display with 1024*768 resolution, it only needs (1024/4)*3 (R, G, B)=768 DACs and OP buffers by using the 1-to-4 data driving method, whereas the charging time of each pixel is only H/4. Although the above method has the advantage of greatly reducing the complexity of circuit, but the charging time of each pixel is short and the charging accuracy is also reduced and thereby affects the grayscale performance of the LCD.

FIG. 2 shows a time-to-voltage diagram of a conventional data driving method in the 1-to-N manner.

As mentioned above, the one of technologic issues on the data driving method of the LCD is to increase the charging time of each pixel while simplifying the structure of 1-to-N data driving circuit so as to improve the grayscale performance.

SUMMARY OF THE INVENTION

The primary object of this invention is to increase the charging time of each pixel while simplifying the structure of 1-to-N data driving circuit so as to improve the grayscale performance of a display.

According to the technology disclosed in the present invention, which provides a method and circuit for data driving of a LCD, the data driving processes can be divided into two stages. In the first stage, the part of most significant bits (MSB) of each binary image data is used to do the pre-selection process and then pre-charge data lines simultaneously to around their corresponding voltages, respectively. In the second stage, the part of least significant bits (LSB) of each binary image data is used to do the post-selection process and then charge the data lines in turn to their corresponding voltage, respectively.

In comparison with the conventional 1-to-1 data driving method, the technology disclosed in the present invention utilizes the 1-to-N data driving method so as to simplify the complexity of the data driving circuit. Furthermore, in comparison with the conventional 1-to-N data driving method which utilizes the means of charging in the time division manner, the provided technology according to the present invention comprises not only the means of pre-charging but also pre-chargers so that it has the advantages of increasing charging time of each pixel and greatly improving the grayscale performance.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
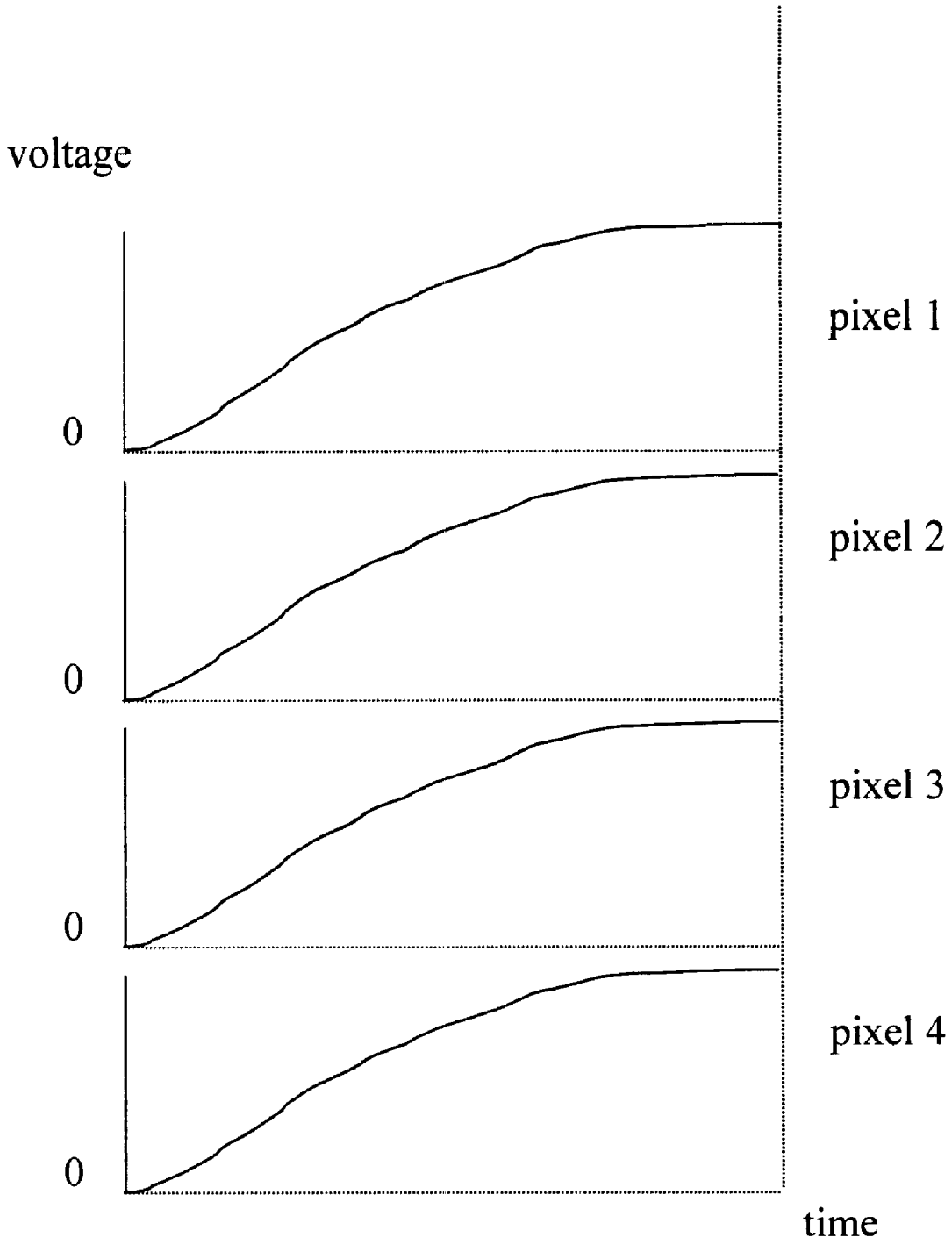
FIG. 1 shows a time-to-voltage diagram of a conventional data driving method in the 1-to-1 manner.
Figure 2:
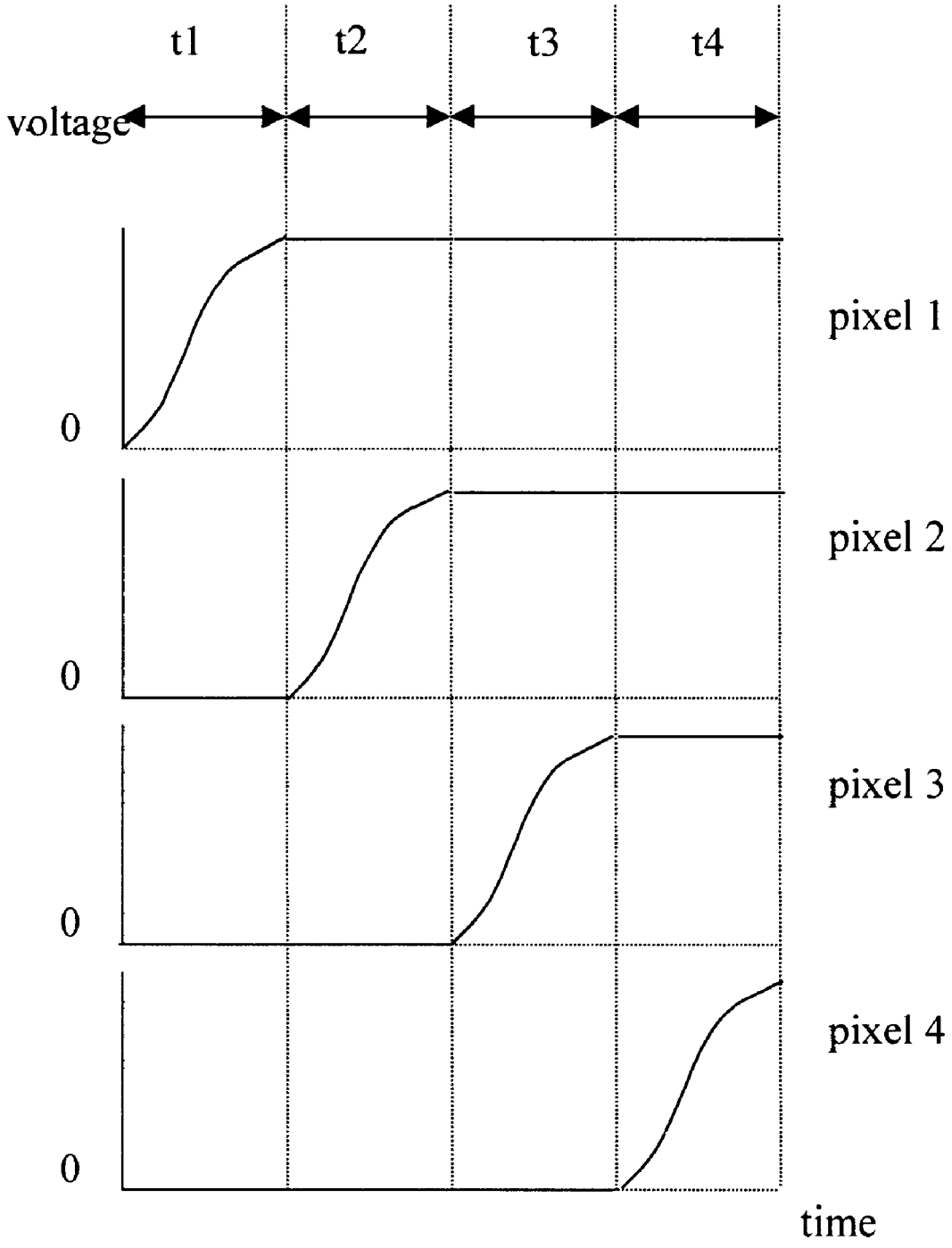
FIG. 2 shows a time-to-voltage diagram of a conventional data driving method in the 1-to-N manner.
Figure 3:
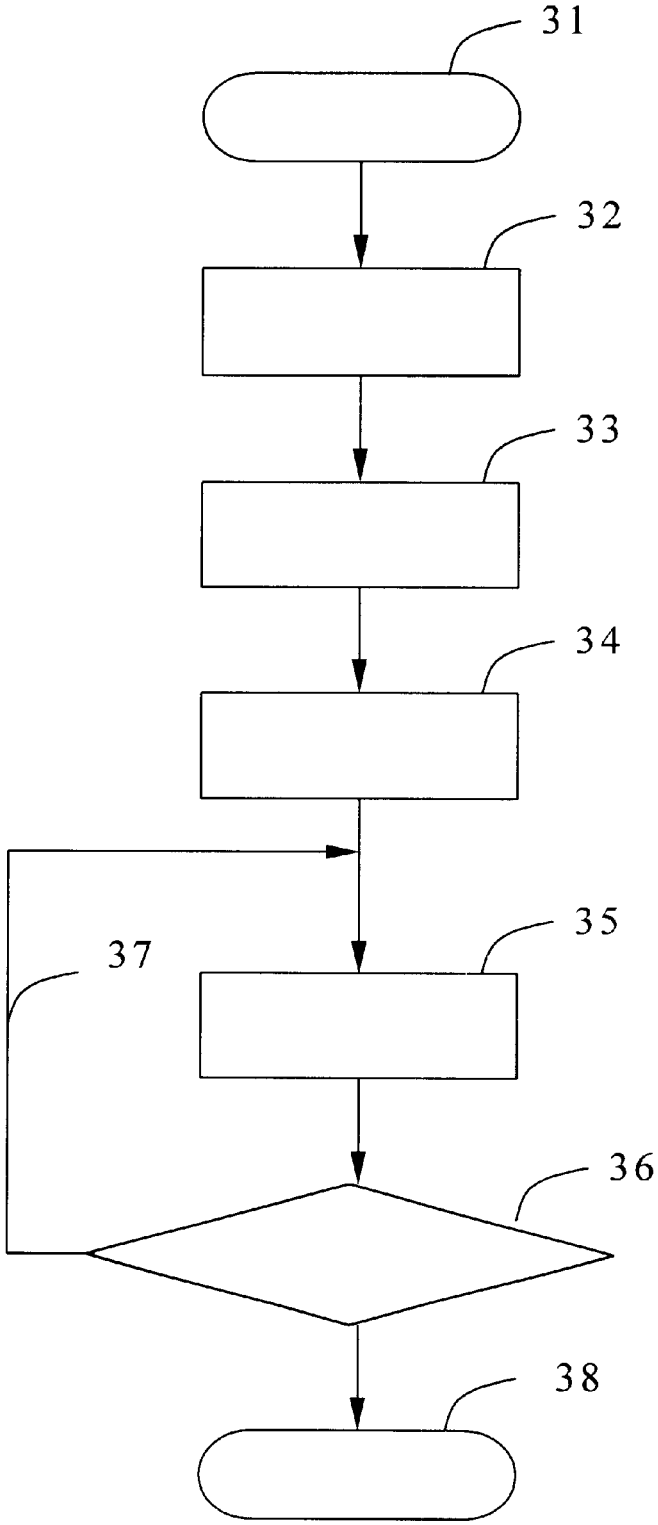
FIG. 3 discloses a flowchart of the method for data driving of a display according to the present invention.

With reference to FIG. 3, the flowchart of the method for data driving of a display according to the present invention comprises the following steps.

1. pre-selection: Suppose a image composed of c bits grayscale can be divided into a MSB part composed of a bits and a LSB part composed of b bits and hence c=a+b. According to the voltage-transparency diagram, equally divide the transparency from 0% (most black) to 100% (most white) into $2^a$ intervals, then the voltages corresponding to the 0%, intersected points, and 100% are sequentially taken as the pre-determined voltages $V_0, V_1, \ldots, V_{2^a}$. Moreover, if the value of the MSB part P of an image data is p, then the base voltage for this image data is the less of $V_p$ and $V_{p+1}$.
2. pre-charging: Connect multiple data lines to pre-chargers and charge each data line simultaneously to its respective pre-determined voltage, the less of $V_p$ and $V_{p+1}$, which is the voltage corresponding to the image data whose value of the MSB part is p.
3. post-selection: Divide the voltage range from $V_p$ to $V_{p+1}$ into $2^b$ intervals with equal magnitude. Therefore, the voltage corresponding to the image data whose value of the LSB part Q is q will be $(V_p\times(2^b-q)+V_{p+1}\times q)/2^b$; and
4. post-charging: Connect multiple data lines to the OP buffer in turn to respectively charge the data lines in the 1-to-N manner to their corresponding voltages more precisely.

The present method is applicable to versatile specifications of image data. For example, if an image is composed of 6 bits grayscale, the MSB part may be chosen as 3 bits and the LSB part is hence 3 bits. Moreover, if an image is composed of 8 bits grayscale, the MSB part may be chosen as 4 bits and the LSB part is hence 4 bits. Of course, the MSB part may be chosen as 5 bits and the LSB part is hence 3 bits. Even if the grayscale of an image exceed 8 bits, the present method is also applicable.

Figure 4:
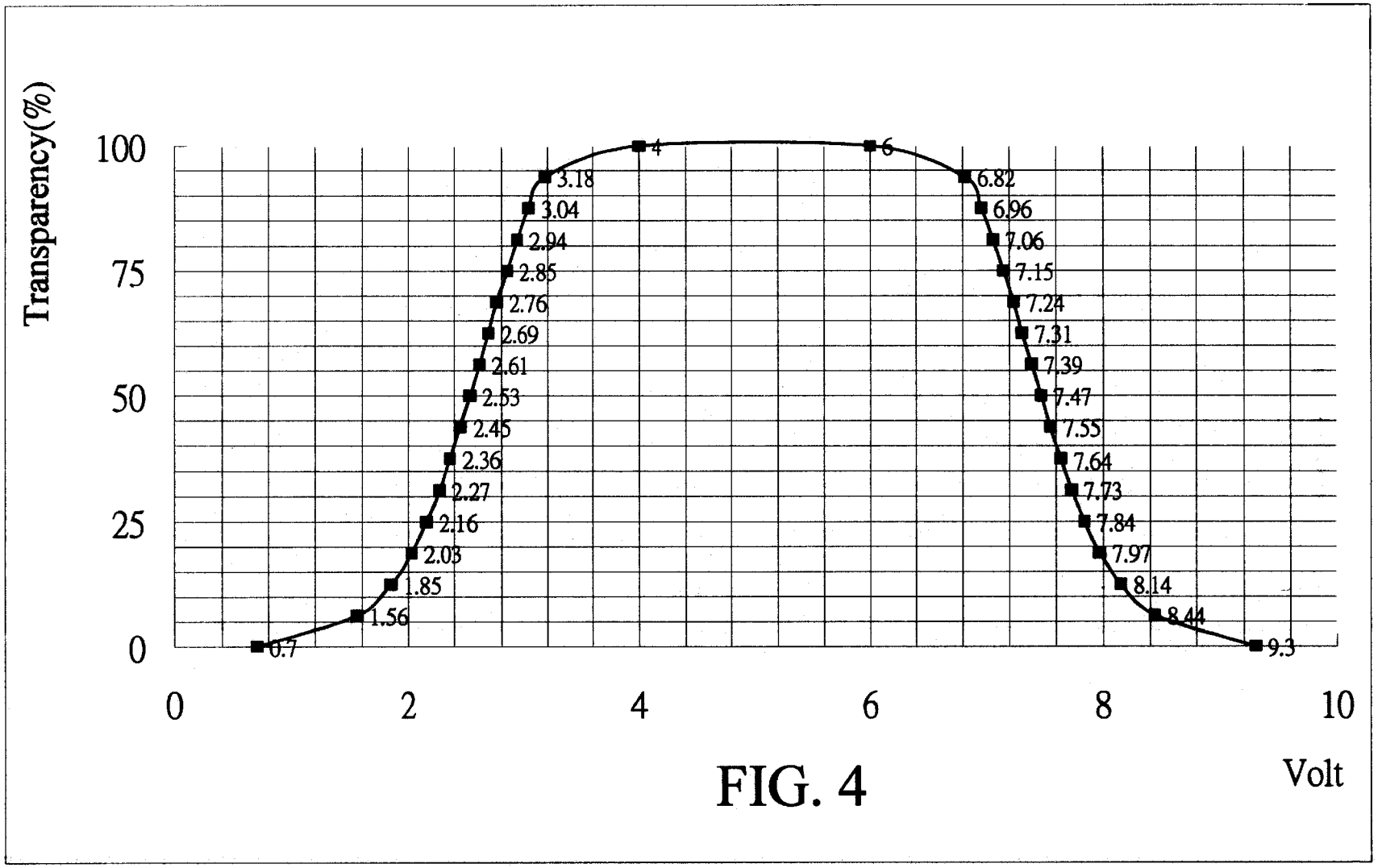
FIG. 4 shows a voltage-to-transparency diagram of the pixels of the LCD.

With reference to FIG. 4, which shows a voltage-to-transparency diagram of the pixels of the LCD.

The LCD includes two parallel glass plates and liquid crystal between them. The upper glass plate contains a common electrode with the common voltage $V_{com}$. The status of each pixel of the LCD is controlled by the difference between the pixel's voltage and the common voltage $V_{com}$. FIG. 4 shows a voltage-to-transparency diagram of the pixels of the LCD. In the right-half side, the pixel's voltage is larger than $V_{com}$, so called "positive polarity region". In the left-half side, the pixel's voltage is less than $V_{com}$, so called "negative polarity region". According to the characteristics of liquid crystal, the pixels should operate in positive or negative polarity region alternatively. The following embodiment is presented in the positive polarity region, the LCD operates in the similar way in negative polarity region.

Figure 5:
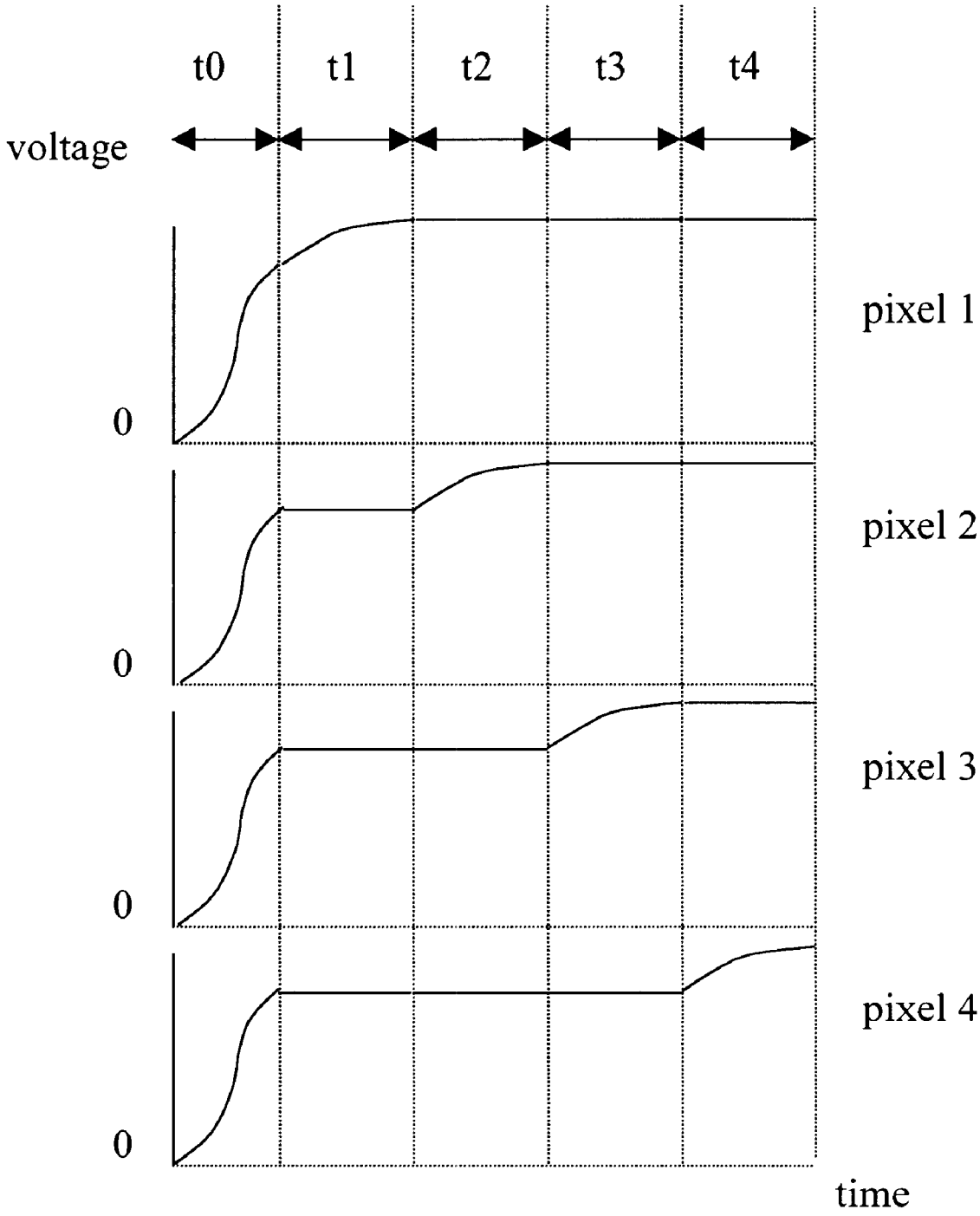
FIG. 5 discloses a time-to-voltage diagram of the method for data driving of a display according to the present invention.

With reference to FIG. 5, which shows a time-to-voltage diagram of the method for data driving of a display according to the present invention.

The method for data driving of a display according to the present invention drives data in two stages. In the first stage, the MSB part of each image data is used to do the pre-selection process and then pre-charge data lines simultaneously to their base voltages, respectively. In the second stage, the LSB part of each image data is used to do the post-selection process and then respectively charge the data lines in turn to their corresponding voltage more precisely.

Suppose the scanning time of each H-sync signal is H. If the time used to charge all data lines simultaneously in the first stage is $t_0$, then the charging time in the second stage must be $(H-t_0)$. By charging in the 1-to-N manner, the charging time allocated for each pixel in the second stage should be $(H-t_0)/N$. Therefore the total charging time of each pixel will be $t_0+(H-t_0)/N=H/N+t_0*(N-1)/N$, which is longer than the total charging time H/N of the conventional 1-to-N data driving method in the time division manner. Since the charging time of each pixel is longer, the charging accuracy will be better and hence the grayscale performance of the display will be better, too.

Figure 6:
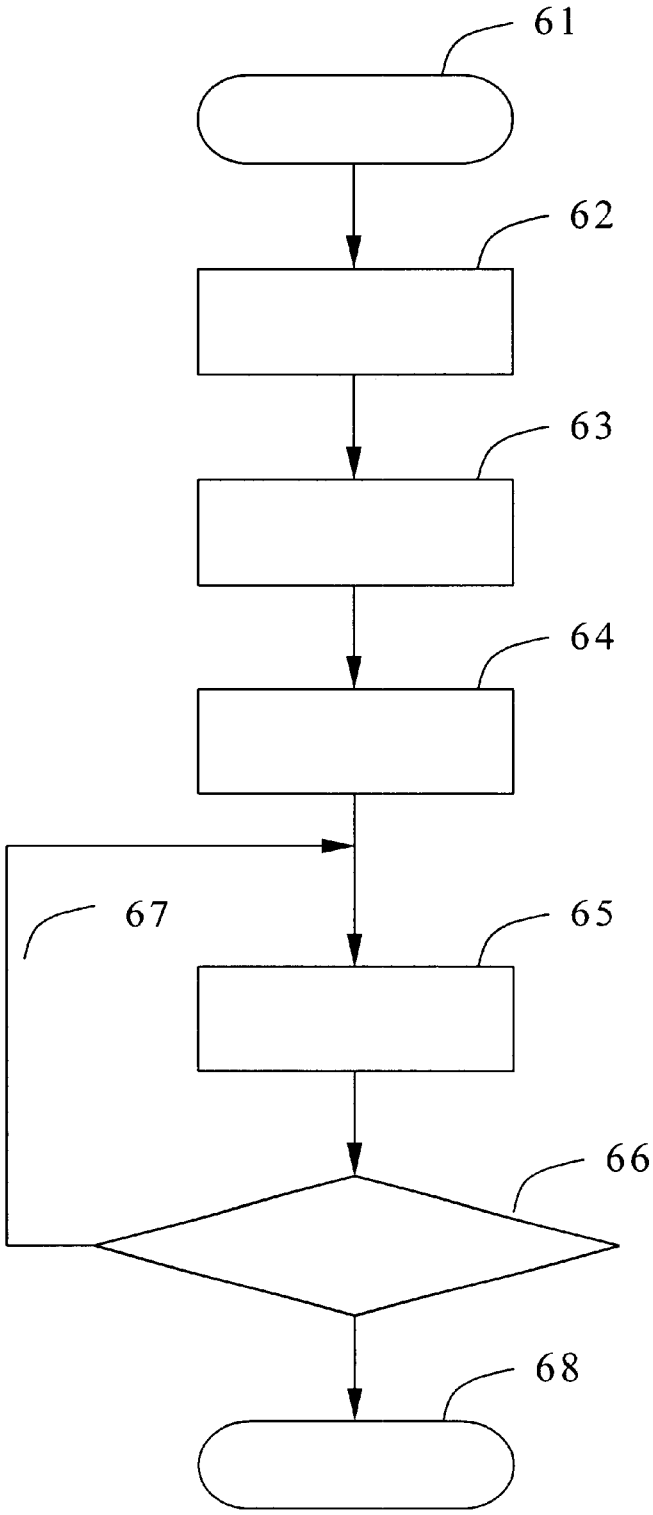
FIG. 6 shows an embodiment of the method for data driving of a display according to the present invention.

With reference to FIG. 6, which shows a flowchart of an embodiment of the method for data driving of a display according to the present invention.

The present embodiment charges in the manner of 1-to-4.

1. pre-selection: An image composed of 6 bits grayscale is divided into two parts, wherein the MSB part is 3 bits and the LSB part is also 3 bits. According to the voltage-to-transparency diagram of the liquid crystal, the transparency from the lowest level to the highest level can be divided into $2^a$=8 intervals and hence obtain 9 pre-determined voltages, $V_0, V_1, \ldots, V_8$. For example, the voltage $V_1$ corresponding to 12.5% transparency is 8.14V, and the voltage $V_2$ corresponding to 25% transparency is 7.84V, and the voltage $V_3$ corresponding to 37.5% transparency is 7.64V. If the binary values of four image datas are 001110, 001111, 010001, and 010010, respectively, then the MSB part of each image data will be 001, 001, 010, 010, respectively, which corresponds to the value of 1, 1, 2, 2, respectively. Therefore the pre-determined voltage of each image data is $V_2$, $V_2$, $V_3$, $V_3$, respectively.
2. pre-charging: Charge the four data lines simultaneously to the voltages of $V_2$, $V_2$, $V_3$, $V_3$, respectively.
3. post-selection: Choose the voltage ranges from $V_1$ to $V_2$, $V_1$ to $V_2$, $V_2$ to $V_3$, and $V_2$ to $V_3$, respectively, as the output ranges of the DAC. And choose the LSB part of the four image datas, 110, 111, 001, and 010 as the inputs to DAC. Since the value of the LSB part of each image data is 6, 7, 1, 2, respectively, therefore by using interpolation method, the corresponding voltage of each image data will be 7.915V, 7.8775V, 7.815V, and 7.79V, respectively. For example, for the image data whose binary value is 001110, the corresponding voltage is calculated by (7.84*6+8.14*2)/8=7.915V; and
4. post-charging: Connect the four data lines to the OP buffer in turn and hence charge each of the data lines in the 1-to-N manner to its corresponding voltage, respectively. Since every data line has been pre-charged in advance, therefore it only needs to charge each data line by 0.075V, 0.0375V, 0.175V, and 0.15V, respectively.

Figure 7:
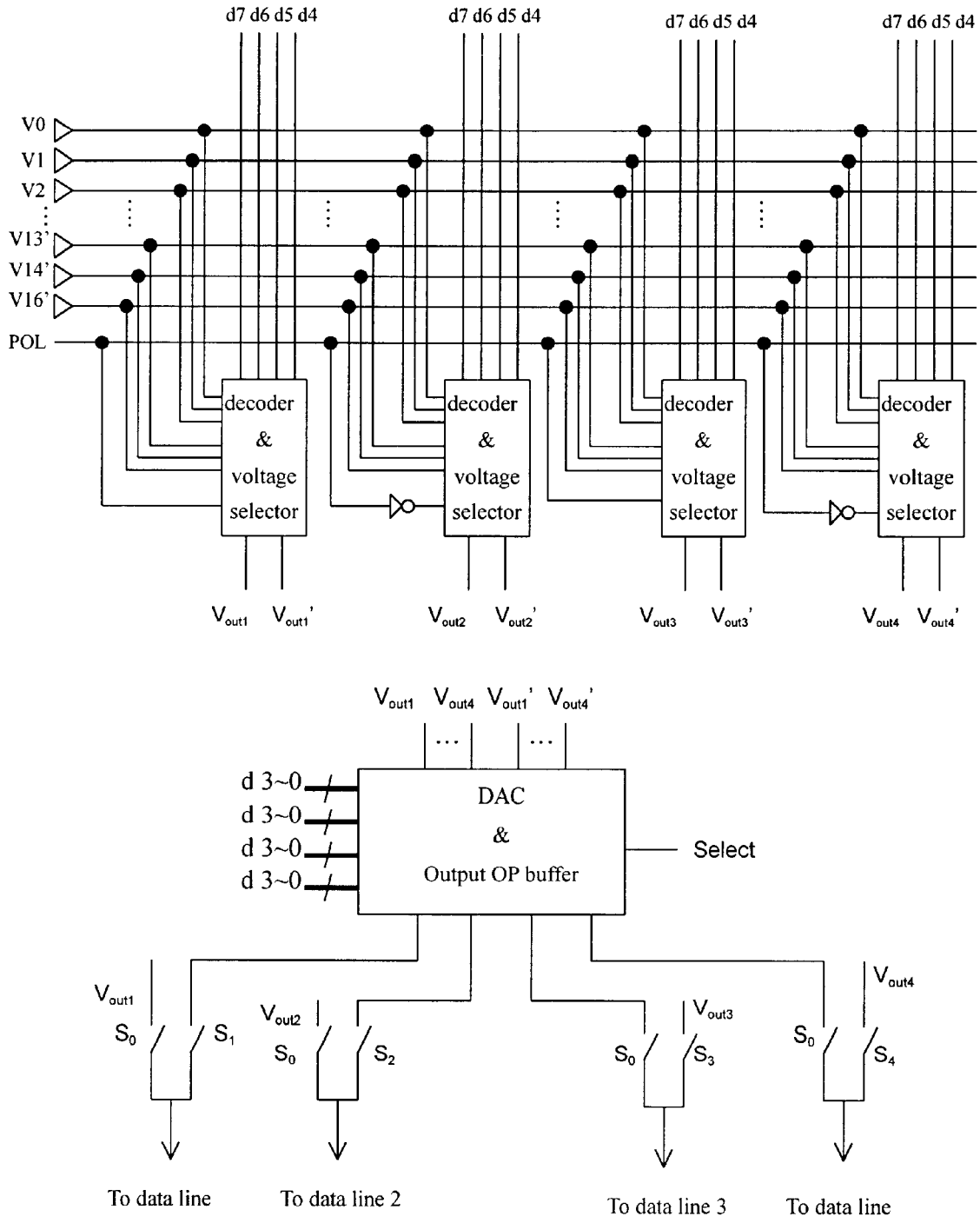
FIG. 7 shows another embodiment of the method for data driving of a display according to the present invention.

With reference to FIG. 7, which shows another embodiment of the method for data driving of a display according to the present invention.

If an image is composed of 8 bits grayscale, wherein the MSB part is 4 bits and the LSB part is also 4 bits.

First, determine 17 pre-determined voltages $V_0$ to $V_{16}$ from the voltage level of 0. By using the decoder, the MSB part P (d7 d6 d5 d4) is converted to the value of p and select the voltage $V_{p+1}$ as the base voltage among the pre-determined voltages. For example, if the binary value of an image data is 01010100, then the value converted from the MSB part 0101 will be 5, therefore, the voltage selector will select $V_6$=7.64V as the base voltage $V_{e1}$ and $V_5$=7.73V as the reference voltage $V_{f1}$.

In the pre-charging step, the switch $S_0$ is set at ON, whereas the switches $S_1$ to $S_4$ are set at OFF. Therefore, the data lines 1 to 4 will be charged simultaneously to their base voltages $V_{e1}$, $V_{e2}$, $V_{e3}$, and $V_{e4}$, respectively.

In the range from $V_{e1}$ to $V_{f1}$, the LSB part Q (d3 d2 d1 d0) is used as the input to the DAC to determine the actual corresponding voltage of the image data. For the example mentioned above, in the range from 7.73V to 7.64V, the LSB part 0100 is used to calculate the corresponding voltage $V_{out1}$ as (7.64*4+7.73*12)/16=7.7075V.

In the post-charging step, the switch $S_0$ is set at OFF, whereas the switches S1 to $S_4$ be set at ON in turn for a period of time according to the timing specificaation, otherwise set at OFF. Therefore, the data lines 1 to 4 will be charged in turn to their corresponding voltages $V_{out1}$, $V_{out2}$, $V_{out3}$, and $V_{out4}$, respectively.

Figure 8:
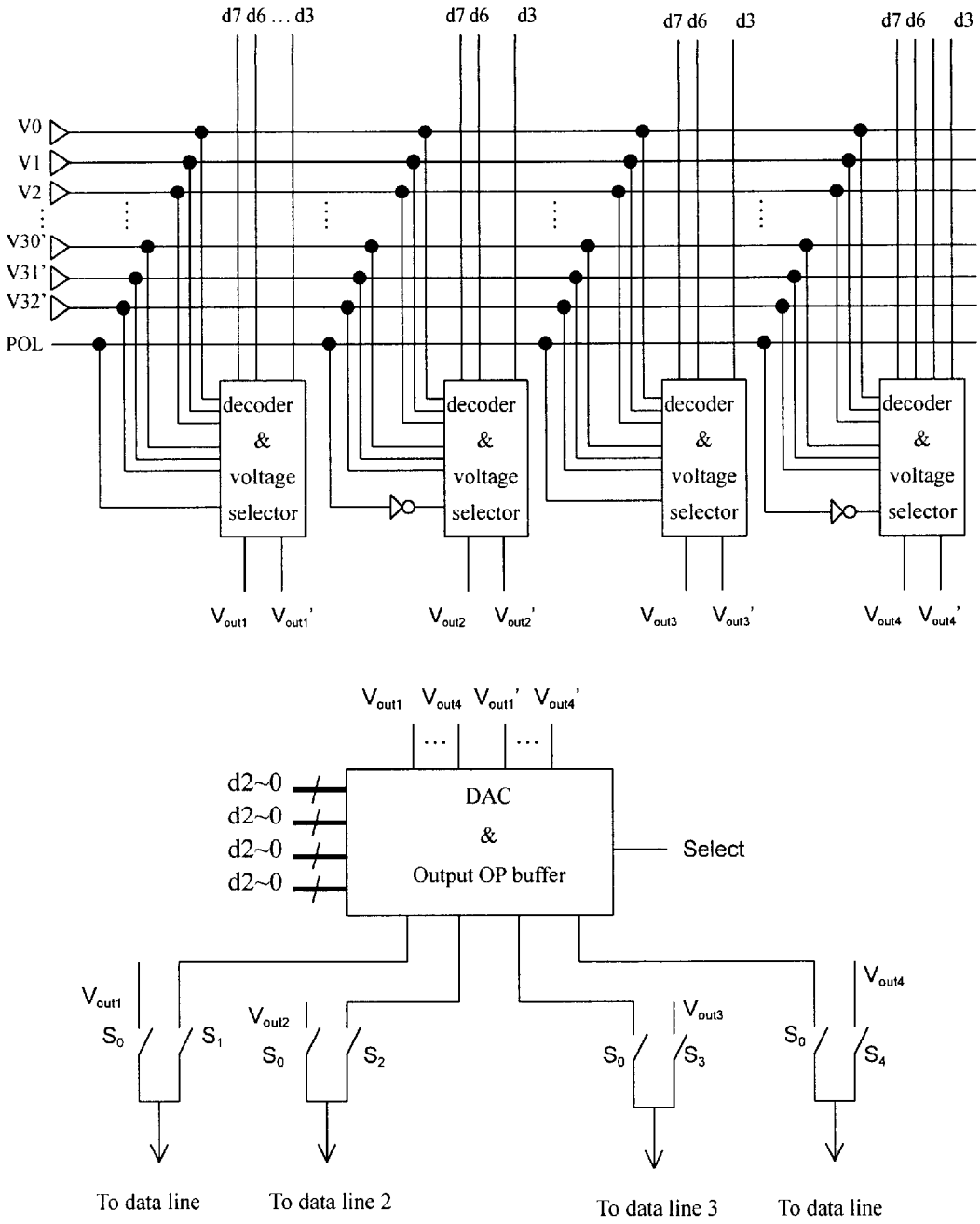
FIG. 8 shows a timing diagram of another embodiment of the method for data driving of a display according to the present invention.

With reference to FIG. 8, which shows the timing diagram of the embodiment of the method for data driving of a display according to the present invention mentioned above.

The H-sync is a horizontal synchronization signal used to start the refreshing of the pixels on a horizontal line of a display.

In the pre-charging step, the switch $S_0$ is set at ON, whereas the switches $S_1$ to $S_4$ are set at OFF. Therefore, the data lines 1 to 4 will be charged simultaneously.

In the post-charging step, the switch $S_0$ is set at OFF, whereas the switches $S_1$ to $S_4$ be set at ON in turn for a period of time according to the timing specification, otherwise set at OFF. Therefore, the data lines 1 to 4 will be charged in turn.

In comparison with the conventional 1-to-1 data driving method, the method and circuit for data driving of a display according to the present invention utilizes the 1-to-N data driving method to simplify the complexity of the data driving circuit. Furthermore, in comparison with the conventional 1-to-N data driving method that utilizes the means of charging in the time division manner, the provided technology according to the present invention comprises not only the means of pre-charging but also the pre-chargers so that it has the advantages of increasing charging time of each pixel and greatly improving the grayscale performance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

DESCRIPTION OF THE SYMBOLS

FIG. 3

31. beginning

32. pre-selection

33. pre-charging

34. post-selection

35. post-charging

36. the data line i used up the allocated charging time?

37. change to the next data line for charging

38. ending

FIG. 5 t0. the time used to pre-charge multiple data lines simultaneously t1, t2, t3, t4. the time used to post-charge each data line

FIG. 6

61. beginning

62. pre-select according to the MSB part composed of 3 bits

63. pre-charging

64. post-select according to the LSB part composed of 3 bits

65. post-charging

66. Has the data line i used up the allocated charging time?

67. change to the next data line for charging

68. ending

FIG. 7

$d_7d_6d_5d_4$. the MSB part of an image data $d_3d_2d_1d_0$. the LSB part of an image data $V_0$~$V_{16}$. a set of pre-determined voltages(positive polarity)

$V_0'$~$V_{16}'$. a set of pre-determined voltages(negative polarity)

$V_{e1}$~$V_{e4}$. base voltages $V_{f1}$~$V_{f4}$. reference voltages $S_0$~$S_4$. analog switches

FIG. 8

H-Sync. horizontal synchronization signal $S_0$~$S_4$. timing of the analog switches

What is claimed is:

1. A method for data driving of a display, which is used to convert image signals into corresponding voltages so as to charge pixels of the display via data lines, comprising the following steps:

a pre-selection step for dividing each binary image data composed of c bits into an MSB part P composed of a bits and an LSB part Q composed of b bits, wherein c=a+b, and selecting a base voltage for each pixel among a set of pre-determined voltages according to the MSB part P of the associated image data;

a pre-charging step for charging multiple data lines simultaneously to the base voltages of the pixels, respectively;

a post-selection step for selecting a corresponding voltage for each pixel according to the base voltage of the pixel and the LSB part Q of the associated image data; and a post-charging step for charging multiple date lines in turn to the corresponding voltages of the pixels, respectively.

2. The method for data driving of a display of claim 1 which further comprising the steps of:

dividing the gray-scale of a pixel into $2^a$ intervals by means of the pre-selection step, wherein the voltages corresponding to the lower limit, intersected point, and the upper limit s are taken as pre-determined voltages, $V_0$, $V_1$, . . . $V_2{}^a$;

selecting the lessor of $V_p$, and $V_{p+1}$ as a base voltage for each pixel among the pre-determined voltages according to a value p of the MSB part P of the associated image data.

3. The method for driving data of a display of claim 2 which further comprising the steps of:

inputting the voltages of $V_p$, and $V_{p+1}$ according the post-selection step;

determining the corresponding voltage for each pixel as $(V_p\times(2^b-q)+V_{p+1}\times q)/2^b$ by using a value q of the LSB part Q of the associated image.

4. The method for data driving of a display of claim 3 wherein the digital-to-analog converter used in the means of the post-selection is of resistor string type.

5. The method for data driving of a display of claim 1 wherein the binary image data is composed of 6 bits grayscale, wherein the MSB part is composed of 3 bits and the LSB part is composed of 3 bits.

6. The method for data driving of a display of claim 1 wherein the binary image data is composed of 8 bits grayscale, wherein the MSB part is composed of 6 bits and the LSB part is composed of 2 bits.

7. The method for data driving of a display of claim 1 wherein the binary image data is composed of 8 bits grayscale, wherein the MSB part is composed of 5 bits and the LSB part is composed of 3 bits.

8. The method for data driving of a display of claim 1 wherein the binary image data is composed of 8 bits grayscale, wherein the MSB part is composed of 4 bits and the LSB part is composed of 4 bits.

9. The method for data driving of a display of claim 1 wherein the binary image data is composed of 8 bits grayscale, wherein the MSB part is composed of 3 bits and the LSB part is composed of 5 bits.

10. The method for data driving of a display of claim 1 wherein the binary image data is composed of 8 bits grayscale, wherein the MSB part is composed of 2 bits and the LSB part is composed of 6 bits.

11. A circuit for data driving of a display, which is used to convert image data into corresponding voltages so as to charge pixels of the display via data lines, comprising:

a pre-charger, for dividing each binary image date composed of c bits into an MSB part P composed of a bits and an LSB part Q composed of b bits, wherein c=a+b, and selecting a base voltage for each pixel among a set of pre-determined voltages according to the MSB part P of the associated image data and then charging multiple date lines simultaneously to the base voltage of the pixels, respectively;

a post-charger, for selecting a corresponding voltage for each pixel according to the base voltage of the pixel and the LSB part Q of the associated image data, and then charging multiple date lines in turn to the corresponding voltages of the pixels, respectively.

12. The circuit for date driving of a display of claim 11 wherein the pre-charger which further comprises:

a device to provide a set of pre-determined voltages, wherein the gray-scale of the pixel is divided into $2^a$ intervals and the voltages corresponding to the upper limit, the lower limit, and intersected points are taken as the pre-determined voltages;

a decoder, for converting the MSB part P into a value p;

a voltage selector, for selecting the lessor of $V_p$, and $V_{p+1}$ as a base voltage for each pixel according to the value p obtained from the decoder; and a set of analog switches, for connecting multiple data lines to the associated voltages, respectively, while pre-charging so as to charge the date lines simultaneously.

13. The circuit for date driving of a display of claim 12 wherein the post-charger which further comprises:

a digital-to-analog converter, wherein the voltages of $V_p$, and $V_{p+1}$ are used as inputs, and the output value of $(V_p\times(2^b-q)+V_{p+1}\times q)/2^b$ is determined by using a value q of the LSB part Q of the associated data;

an amplifier, which is used as an output buffer so as to connect the output of the digital-to-analog converter to the pixels of the display; and a set of analog switches, which is used to connect the output of the digital-to-analog converter to multiple data lines in turn while post-posting so as to charge the data lines.

14. The circuit for data driving of a display of claim 13 wherein the digital-to-analog converter used in the post-charger circuit is of resistor string type.

15. The circuit for data driving of a display of claim 11 wherein the binary image data is composed of 6 bits, wherein the MSB part is composed of 3 bits and the LSB part is composed of 3 bits.

16. The circuit for data driving of a display of claim 11 wherein the binary image data is composed of 8 bits grayscale, wherein the MSB part is composed of 6 bits and the LSB part is composed of 2 bits.

17. The circuit for data driving of a display of claim 11 wherein the binary image data is composed of 8 bits grayscale, wherein the MSB part is composed of 5 bits and the LSB part is composed of 3 bits.

18. The circuit for data driving of a display of claim 11 wherein the binary image data is composed of 8 bits grayscale, wherein the MSB part is composed of 4 bits and the LSB part is composed of 4 bits.

19. The circuit for data driving of a display of claim 11 wherein the binary image data is composed of 8 bits grayscale, wherein the MSB part is composed of 3 bits and the LSB part is composed of 5 bits.

20. The circuit for data driving of a display of claim 11 wherein the binary image data is composed of 8 bits grayscale, wherein the MSB part is composed of 2 bits and the LSB part is composed of 6 bits.

* * * * *